US005918789A

United States Patent [19]

Olvera et al.

[11] Patent Number: 5,918,789

[45] Date of Patent: Jul. 6, 1999

[54] FASTNER COLLATION TUBE FOR STAND-UP FASTENER DRIVING TOOL

[75] Inventors: Gilbert Olvera, Chicago; Sigismund G. Paul, Park Ridge, both of Ill.

[73] Assignee: Illinois Tool Works Inc., Glenview, Ill.

[21] Appl. No.: 08/928,594

[22] Filed: Sep. 12, 1997

[51] Int. Cl.[6] ..... B25C 5/06; B25C 7/00

[52] U.S. Cl. ..... 227/119; 227/107; 227/139

[58] Field of Search ..... 227/135, 136, 227/137, 119, 104, 138; 72/409.04, 409.06; 29/809, 811.2, 813; 221/287, 197

[56] References Cited

U.S. PATENT DOCUMENTS

| | | | |
|---|---|---|---|
| 1,073,348 | 9/1913 | Hoagland | 42/87 |
| 2,445,674 | 4/1948 | Kendall | 227/112 |
| 3,283,985 | 11/1966 | Willis | 227/119 |
| 3,960,191 | 6/1976 | Murray . | |
| 4,139,136 | 2/1979 | Catalano | 227/109 |
| 4,171,753 | 10/1979 | Vreede | 221/197 |
| 4,199,093 | 4/1980 | Combette et al. | 227/9 |
| 4,311,251 | 1/1982 | Sternberg | 221/24 |
| 4,313,552 | 2/1982 | Maurer | 227/109 |
| 4,389,012 | 6/1983 | Grikis et al. | 227/120 |
| 4,463,888 | 8/1984 | Geist et al. | 227/109 |
| 4,573,610 | 3/1986 | Hurner . | |
| 4,824,003 | 4/1989 | Almeras et al. . | |
| 4,998,660 | 3/1991 | Kanzaka | 227/18 |
| 5,005,750 | 4/1991 | Scala | 227/109 |
| 5,178,298 | 1/1993 | Allina | 221/24 |
| 5,192,012 | 3/1993 | Schafer et al. | 227/113 |
| 5,193,729 | 3/1993 | Dewey et al. . | |
| 5,199,506 | 4/1993 | Dewey et al. . | |
| 5,199,625 | 4/1993 | Dewey et al. . | |
| 5,238,167 | 8/1993 | Howard et al. | 227/110 |
| 5,302,068 | 4/1994 | Janusz et al. . | |
| 5,511,690 | 4/1996 | Calhoun et al. | 221/197 |
| 5,692,664 | 12/1997 | Vettoretti et al. | 227/10 |

*Primary Examiner*—Peter Vo
*Assistant Examiner*—Bobby Rushing, Jr.
*Attorney, Agent, or Firm*—Schwartz & Weinrieb

[57] ABSTRACT

A unitary fastener collation tube for retaining a plurality of fasteners useable in a stand-up fastener driving tool. The fastener collation tube includes an elongated body member having a channel having a substantially T-shaped cross section for receiving the fasteners arranged side by side therein. At least one end of the elongated body member includes a resilient fastener retaining member engageable with an endmost fastener of the plurality of fasteners so as to retain the plurality of fasteners in the channel of the fastener collation tube, whereby the plurality of fasteners retained in the fastener collation tube are releasable from the fastener collation tube when the resilient fastener retaining member is disengaged from the endmost fastener. The stand-up fastener driving tool includes a magazine with a slot for retaining a plurality of fasteners arranged side by side therein, and a tube holder coupled to the magazine for receiving the fastener collation tube, wherein a corresponding prong extending into the channel of the tube holder is engageable with the resilient fastener retaining member of the elongated body member so as to disengage the resilient fastener retaining member from the endmost fastener disposed therein.

15 Claims, 2 Drawing Sheets

FASTNER COLLATION TUBE FOR STAND-UP FASTENER DRIVING TOOL

CROSS-REFERENCE TO RELATED APPLICATIONS

The present patent application is related to copending U.S. application Ser. No. 08/928,593, filed on Sep. 12, 1997 entitled "Fastener Dispensing Apparatus for Stand-Up Fastener Driving Tool and Method Therefor", incorporated by reference herein.

FIELD OF THE INVENTION

The present invention relates generally to stand-up fastener driving tools, and more particularly to fastener collation tubes for retaining a plurality of screw fasteners and useable in combination with a tube holder coupled to a fastener magazine of a stand-up fastener driving tool.

BACKGROUND OF THE INVENTION

The advent of stand-up fastener driving tools marked a significant advance in the installation of fasteners through overlapping members and into an underlying support member, collectively referred to herein as a deck, as is conventional in the roofing and flooring industries. U.S. Pat. No. 5,302,068 entitled "Fastener Having Recessed Non-Circular Head, and Fastener-Driving Tool" issued to Janusz et al. on Apr. 12, 1994 and commonly assigned herewith, for example, discloses a stand-up screw gun generally including a trigger actuatable rotary driver, which is an industrial quality hand-held electric tool, coupled to a screw driving member, with a socket portion, by a rotatable shaft extending through an outer upper tube coupled to the rotary driver and an inner lower tube telescopingly biased away from the rotary driver by a compressed spring member disposed within the upper tube.

The screw driving member of U.S. Pat. No. 5,302,068 is movable from an inoperative position to an operative position relative to a nose-piece coupled to a distal end of the inner lower tube upon depressing the nose-piece against the deck so as to telescopingly move the inner lower tube toward the rotary driver against the bias of the compressed spring member. In the operative position, the socket portion engages a screw retained in a screw driving position between pivotal jaws of the nose-piece so that the screw is aligned axially with the screw driving member, whereupon continued depression of the nose-piece against the deck pivotally opens the jaws so as to release the screw and extends the screw driving member through the nose-piece, thereby driving the screw into the deck. According to a related aspect of U.S. Pat. No. 5,302,068, the screw driving member includes a spring biased centering pin with a convex end disposable in a concave recess formed in the screw head for axially centering the screw with the screw driving member, and more particularly with the socket portion thereof. In one embodiment, the convex end of the centering pin and the concave recess of the screw have complementary frusto-conical surfaces to rotationally orient the screw relative to the socket portion of the screw driving member, thereby facilitating engagement of the screw by the socket portion.

The stand-up screw gun of U.S. Pat. No. 5,302,068 also includes a screw feed tube disposed alongside the telescoping upper and lower tubes. An upper end of the feed tube includes a funnel to facilitate manual insertion of screws therein, wherein the screws are gravity fed from the upper end of the feed tube toward a lower end thereof, which is coupled to the nose-piece by a mounting block. A passage through the mounting block directs screws from the feed tube to the screw driving position between the pivotal jaws of the nose-piece when the screw driving member is retracted away from the nose-piece in the inoperative position. Stand-up screw guns incorporating these and other aspects of the invention disclosed in U.S. Pat. No. 5,302,068 are available commercially from ITW Buildex, Itasca, Ill. under the trademarks Autotraxx™ and Fastraxx™.

In many stand-up fastener driving tools, including the stand-up screw gun of U.S. Pat. No. 5,302,068, the operator must insert each screw into the feed tube individually, wherein a second screw cannot be inserted into the feed tube until the previously inserted screw has been driven into the deck. Feeding more than one screw into the feed tube may result in obstruction of the screw driving member as it moves between the inoperative and operative positions. And feeding a second screw into the feed tube while the screw driving member is in the operative position may prevent the screw driving member from retracting fully away from the nose-piece after installation of a previously fed screw. The inventors of the present invention recognize the desirability of eliminating the necessity of manually inserting each screw into the feed tube prior to installation, only after a previously inserted screw has been installed into the deck, which is time consuming and distracting.

Others have endeavored to provide improved fastener loading features in stand-up fastener driving tools. U.S. Pat. No. 3,960,191 entitled "Fastener Feeding and Driving Attachment" issued to Murray on Jun. 1, 1976, commonly assigned herewith, for example, discloses a stand-up screw gun having a feed tube for retaining a plurality of screws therein. The feed tube is coupled to a nose-piece disposed on an end of a telescoping tube assembly. A pivotal arm alternately positions ears at opposing ends thereof into the feed tube during retraction and extension of the telescoping tubes, wherein the ears of the pivotal arm release one of a plurality of screws retained in the feed tube toward the nose-piece as the telescoping tube assembly is extended after installation of a previously released screw. More recently, U.S. Pat. No. 5,199,625 entitled "Fastener Driving Tool Assembly With Improved Fastener-Loading Features", issued on Apr. 6, 1993 to Dewey et al., also commonly assigned herewith, discloses a flexible tube for retaining several pins disposed therein, and for directing the pins into a slot formed in a nose-piece of a stand-up fastener driving tool. A shuttle member is movable transversely in the slot toward an aperture of the nose-piece so as to transfer a pin disposed in the slot to the aperture of the nose-piece where the pin is retained by a magnet in axial alignment with the pin driving member until the pin is engaged thereby. The shuttle permits only one pin at a time from dropping from the feed tube into the slot, which occurs when the shuttle is retracted away from the aperture of the nose-piece.

The configurations of U.S. Pat. Nos. 5,302,068 and 3,960,191 require that the screws be loaded individually into the feed tube by the operator, which is often a distracting and arduous task in the field, particularly during inclement weather conditions and at precarious work sites. And although the configurations of U.S. Pat. Nos. 5,199,625 and 3,960,191 include a fastener feed tube portion for retaining a plurality of screws of pins therein for use during tool operation, the screws or pins must be loaded, or stacked, into the feed tube in a head-to-point relationship, which limits the number of fasteners retainable therein.

U.S. Pat. No. 4,199,093 entitled "Self-Closing Propellant Charge Package" issued on Apr. 22, 1980 discloses a tube assembly for housing a plurality of charge packages arranged end to end therein for use by a power actuated tool. An open end portion of the tube is deformably constricted by a separate resilient ring disposed thereabout so as to retain the charge packages therein. A loading device of the tool includes end portions projecting into the tube so as to expand the constricted portion thereof outwardly against the bias of the resilient ring and thereby allow the charges disposed in the tube to be transferred into the tool. The tube assembly of U.S. Pat. No. 4,199,093 however houses the charge packages in an end-to-end arrangement, which limits the number of charges retainable therein. Also, the tube assembly of U.S. Pat. No. 4,199,093 has multiple components including the separate resilient ring, which requires assembly and increases production costs.

The present invention is directed toward novel advancements in the art of fastener collation tubes for retaining a plurality of fasteners usable in stand-up fastener driving tools.

OBJECTS AND SUMMARY OF THE INVENTION

It is thus an object of the invention to provide a novel fastener collation tube for retaining a plurality of fasteners useable in stand-up fastener driving tools, and combinations thereof, that overcome problems with the prior art, and that are economical and reliable.

It is more particular object of the invention to provide a fastener collation tube for retaining a plurality of screw fasteners, and more generally fasteners, arranged side by side and useable in a stand-up fastener driving tool. The fastener collation tube includes an elongated body member having a channel for receiving the fasteners therein. The channel has a substantially T-shaped cross section defined by opposing side walls adjacent the fastener shank, opposing side wall shoulders adjacent a bottom surface of the fastener head, substantially opposing crown portions adjacent side portions of the fastener head, and an end wall adjacent a top surface of the fastener head. At least one end of the elongated body member includes a fastener retaining member, or tube closure member, engageable with the plurality of fasteners so as to retain the plurality of fasteners in the channel of the fastener collation tube, whereby the plurality of fasteners retained in the fastener collation tube are releasable therefrom when the fastener retaining member, or tube closure member, is disengaged from the fasteners in the fastener collation tube.

It is also an object of the invention to provide a fastener collation tube as discussed generally above wherein the fastener retaining member is at least one resilient tab protruding into the channel of the elongated body member from a side of the elongated body member at or near a first end thereof. In an alternative embodiment, the fastener retaining member is two resilient tabs protruding into the channel of the elongated body member from substantially opposing sides of the elongated body member at or near the first end thereof, and more particularly from substantially opposing crown portions of the elongated body member. And it is a related object of the invention to form the one or more resilient tabs from a partially cut portion of the elongated body member, whereby the fastener collation tube is a unitary member, which is formable of a plastic or other material.

It is another object of the invention to provide a fastener collation tube having one or more resilient tabs protruding into the channel of the elongated body member toward opposing first and second ends of the elongated body member.

It is another object of the invention to provide a fastener collation tube as discussed above in combination with a stand-up fastener driving tool including a magazine having a slot for retaining a plurality of fasteners arranged side by side, a tube holder for receiving the fastener collation tube, wherein the tube holder includes a channel aligned with and coupled to the magazine slot. A prong extending into the channel of the tube holder is engageable with the resilient fastener retaining member of the elongated body member so as to disengage the resilient fastener retaining member from the fasteners when the fastener collation tube is disposed in the channel of the tube holder, whereby the fasteners retained in the fastener collation tube are released into the magazine slot when the resilient fastener retaining member is disengaged from the fasteners disposed in the channel of the elongated body member. According to a related aspect of the invention, the stand-up fastener driving tool is operational when the fastener collation tube is disposed in the tube holder thereof.

BRIEF DESCRIPTION OF THE DRAWINGS

The foregoing and other objects, features, aspects and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators, throughout the several views, and wherein.

DETAILED DESCRIPTION OF THE INVENTION

Figure 1A:
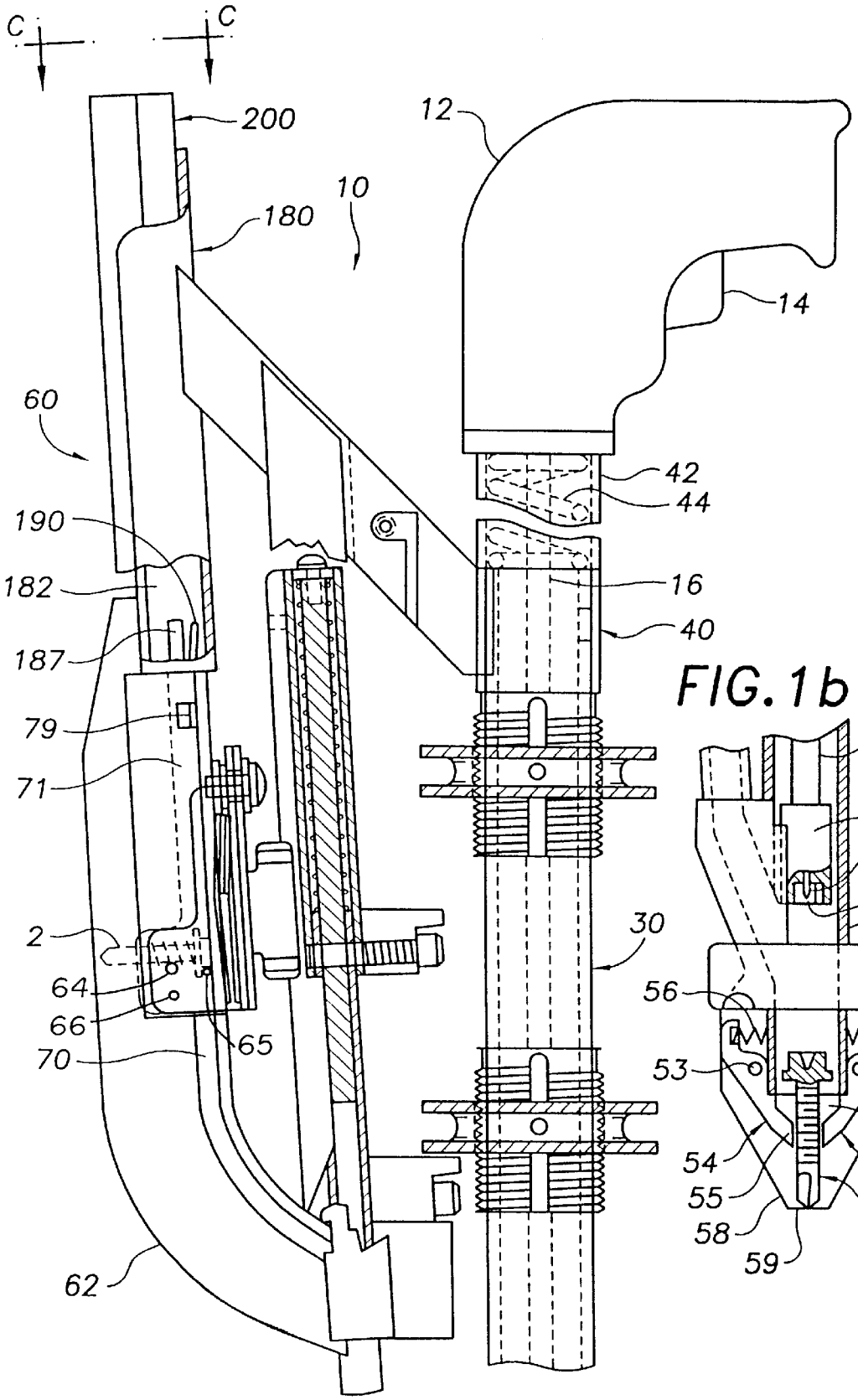
FIG. 1*a* is a partial side view of an upper portion of a stand-up fastener driving tool including a fastener magazine and dispenser assembly according to an exemplary embodiment of the invention.
Figure 1B:
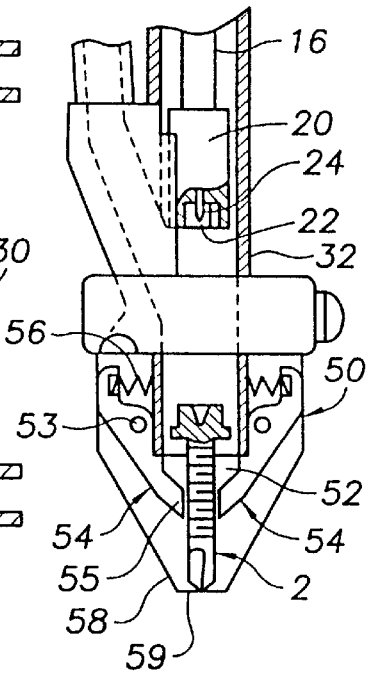
FIG. 1*b* is a partial side view of a lower portion of a stand-up fastener driving tool including a nose-piece thereof, which forms a part of the stand-up fastener driving tool of FIG. 1*a*.

FIGS. 1*a*–1*b* illustrate a fastener driving tool 10 comprising generally a rotary driver 12, which may be an electric tool actuatable by a trigger 14, having a rotatable shaft 16 with a fastener driving member 20 disposed on a distal end of the rotatable shaft 16. The exemplary fastener driving member 20 includes a socket 22 engageable with a frusto-conical shaped fastener head and an axially aligned pin 24 biased into the socket 22 for aligning a fastener 2 with the socket 22 as disclosed more fully in an embodiment of U.S. Pat. No. 5,302,068 entitled "Fastener Having Recessed Non-Circular Head, and Fastener-Driving Tool" issued on Apr. 12, 1994, commonly assigned herewith, and incorporated by reference herein.

The stand-up fastener driving tool 10 includes also a lower tube 30 telescopingly coupled to an upper tube 40 having an upper end 42 coupled to the rotary driver 12. The lower tube 30 has a lower end 32 biased away from the rotary driver 12 by a spring member 44 disposed within the upper tube 40. A nose-piece 50 is coupled to the lower end 32 of the lower tube 30, wherein the nose-piece 50 generally includes an opening 52 for retaining the fastener 2 in a fastener driving position aligned axially with the fastener driving member 20 disposed axially in the lower tube 30. The fastener driving member 20 is extendable toward the nose-piece 50 upon contraction of the lower tube 30 relative to the upper tube 40 against the bias of the compressed spring 44, and the fastener driving member 20 is retractable away from the nose-piece 50 upon extension of the lower tube 30 relative to the upper tube 40.

The nose-piece 50 of the exemplary embodiment of FIG. 1 includes two jaws 54 having corresponding fastener retaining ends 55, which are pivotally biased toward each other about a corresponding pivot 53 by a corresponding spring member 56 to at least partially define the opening 52 between the fastener retaining ends 55. The nose-piece 50 also includes two opposing plate members 58, only one of which is shown in FIG. 1*b*, coupled to the lower end 32 of the lower tube 30 and pivotally supporting the two jaws 54. A tip 59 of the plate members 58 is depressably engageable against a deck, or workpiece, not shown, for contracting the lower tube 30 relative to the upper tube 40, whereupon the fastener driving member 20 is extendable toward the nose-piece 50 and is engageable with a fastener 2 retained between the jaws 54 thereof as the lower tube 30 is contracted relative to the upper tube 40. Further contraction of the lower tube 30 relative to the upper tube 40 extends the fastener 2 engaged by the fastener driving member 20 between the jaws 54, which are pivoted away from each other against the bias of spring members 56 so as to increase the opening 52 therebetween, thereby releasing the fastener 2 from the jaws 54, whereby the fastener 2 is installable into the workpiece. Various configurations of the fastener driving member 20 and the nose-piece 50 and the operation thereof are disclosed more fully in U.S. Pat. No. 5,302,068 entitled "Fastener Having Recessed Non-Circular Head, and Fastener-Driving Tool" issued on Apr. 12, 1994, commonly assigned herewith, and incorporated by reference herein.

FIG. 1*a* illustrates the stand-up fastener driving tool 10 including a magazine 60 having a slot 70 between opposing guide rails 62 thereof and one or more upper and lower pins 64 and 66 actuatably extendable into and retractable out of the magazine slot 70 for retaining a plurality of fasteners arranged side by side in an upper portion 71 of the magazine slot 70. The exemplary embodiment includes two upper pins 64 and 65 and only one lower pin 66, but other configurations may also include two lower pins. The upper pins 64 and 65 are extended into the magazine slot 70 and the lower pin 66 is retracted out of the magazine slot 70 as the lower tube 30 is extended relative to the upper tube 40, wherein the upper pins 64 and 65 retain the plurality of fasteners in the upper portion 71 of the magazine slot 70 as shown. Only a single fastener 2 is shown in FIG. 1 to reduce the complexity of the drawing. The lower pin 66 is substantially alternately extendable into the magazine slot 70 and the upper pin is retractable out of the magazine slot 70 as the lower tube 30 is contracted relative to the upper tube 40, wherein the lower pin 66 retains the plurality of fasteners 2 in the magazine 70. In some configurations, both the upper and lower pins 64, 65, 66 may be extended into the magazine slot 70 simultaneously during some phase of the contraction and extension of the upper and lower tubes 30 and 40. These and other aspects of the invention are disclosed more fully in copending U.S. application Ser. No. 08/928,593, filed on Sep. 12, 1997 entitled "Fastener Dispensing Apparatus for Stand-Up Fastener Driving Tool and Method Therefor", incorporated by reference herein.

Figure 2:
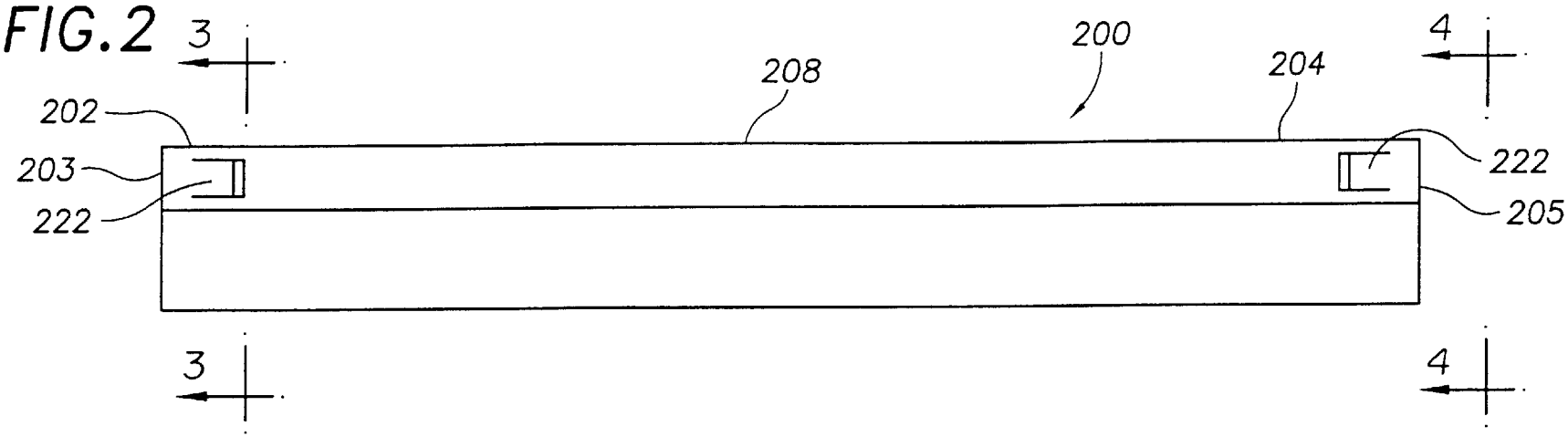
FIG. 2 is a side elevational view of a fastener collation tube useable in combination with the stand-up fastener driving tool of FIG. 1.
Figure 5:
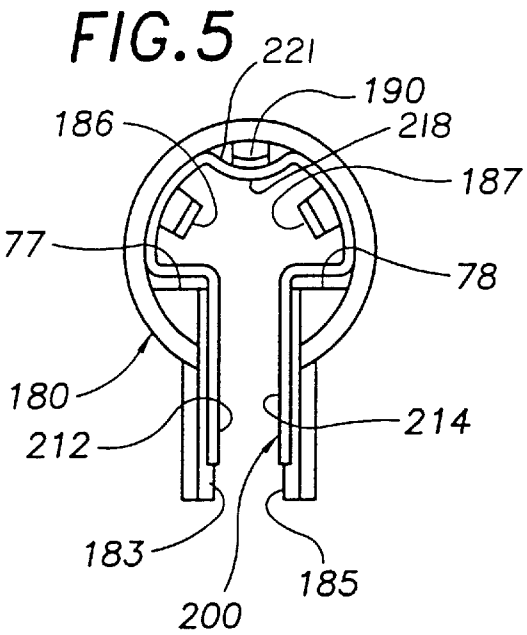
FIG. 5 is a partial end view of the fastener driving tool of FIG. 1*a* as taken along lines 5—5 of FIG. 1*a* illustrating the fastener collation tube disposed in the fastener tube holder.

FIG. 1*a* illustrates the magazine 60 coupled to a tube holder 180 including a longitudinal channel 182 for receiving a fastener collation tube 200, shown also in FIG. 2. The channel 182 of the tube holder 180 is aligned with and coupled to the upper portion 71 of the magazine slot 70. FIG. 5 illustrates edge portions 183 and 185 formed on a portion of the magazine 60 toward the tube holder 180, wherein the edge portions 183 and 185 form an abutment surface against which the fastener collation tube 200 is seatable when disposed in the tube holder 180.

Figure 4:
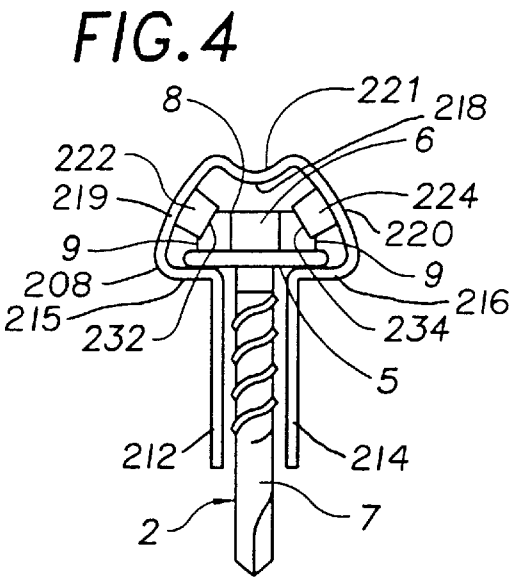
FIG. 4 is an end view of the fastener collation tube of FIG. 2 as taken along lines 4—4 of FIG. 2 illustrating also a fastener retained within the channel of the fastener collation tube.
Figure 3:
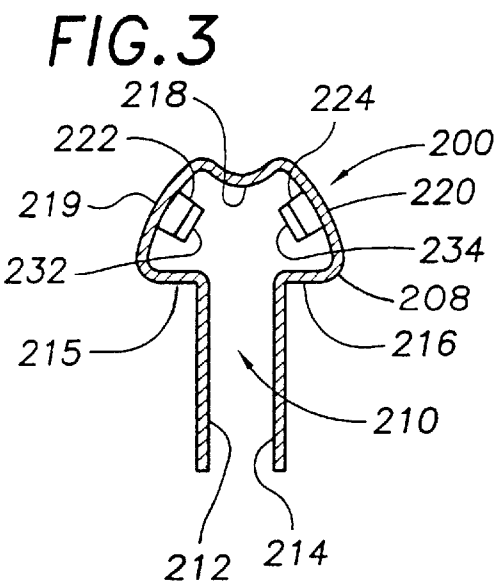
FIG. 3 is a sectional view of the fastener collation tube of FIG. 2 as taken along lines 3—3 of FIG. 2.

FIGS. 3 and 4 illustrate the fastener collation tube 200 including an elongated body member 208 having a channel 210 for retaining a plurality of fasteners 2 having a head 6 and a shank 7 arranged side by side therein. The fasteners 2 in the exemplary embodiment are screw fasteners. The fastener collation tube 200 is removably disposable in the channel 182 of the tube holder 180 so as to couple the channel 210 of the fastener collation tube 200 with the magazine slot 70, whereby the plurality of fasteners 2 arranged side by side in the fastener collation tube 200 are transferrable to and disposably retained in the upper portion 71 of the magazine slot 70. The fastener collation tube 200 may be removed from channel 182 of the tube holder 180 upon transferring the fasteners 2 into the magazine 60, since a supply of fasteners 2 is retained in the upper portion 71 of the magazine slot 70 for use during operation of the stand-up fastener driving tool 10. Alternatively, the fastener collation tube 200 may remain in the channel 182 of the tube holder 180 during operation of the tool 10, whereby the channel 210 of the fastener collation tube 200 extends the upper portion 71 of the magazine slot 70.

FIGS. 3 and 4 illustrate, more particularly, the channel 210 of the fastener collation tube having a substantially T-shaped cross section defined by opposing side walls 212 and 214 adjacent the fastener shank 7, oppositely extending side wall shoulders 215 and 216 adjacent a bottom surface 5 of the fastener head 6, an end wall 218 adjacent a top surface 8 of the fastener head 6, and substantially opposing crown portions 219 and 220 adjacent a circumferential fastener head side portion 9 between the opposing side wall shoulders 215 and 216 and the end wall 218. And though the end wall 218 and the crown portions 219 and 220 have arcuate surfaces in the exemplary embodiment, alternative embodiments may have other forms. The end wall 218 and the crown portions 219 and 220 may, for example, have relatively linear surfaces, or may have a substantially continuously curved surface.

The fastener collation tube 200 generally includes a resilient fastener retaining member for retaining the fasteners in the channel 210 thereof. In the exemplary embodiment of FIGS. 2, 3 and 4, the fastener retaining member comprises two resilient tabs 222 and 224 located within the vicinity of oppositely disposed first and second ends 202 and 204 thereof, wherein the resilient tabs 222 and 224 protrude into the channel 210 of the elongated body member 208 from corresponding crown portions 219 and 220 between the corresponding shoulders 215 and 216 and the end wall 218. In alternative embodiments, however, one end of the fastener collation tube 200 may be capped or blocked by other means, and the resilient tabs 222 and 224 may be disposed near or on only one end of the elongated body member 208.

In other alternative embodiments, a single resilient tab extends into the channel 210 of the elongated body member 208 from only one of the opposing side walls 212 and 214, or from opposing crown portions 219 and 220, or from the end wall 218 thereof. And in other alternative embodiments, the fastener retaining member is a crimped, or a twisted, or a bent end portion of the elongated body member 208.

The resilient tabs 222 and 224 are oriented so as to extend away from corresponding open ends 203 and 205 of the elongated body member 208 and into the channel 210 thereof. According to this aspect of the invention, the resilient tabs 222 and 224 are flexible out of the channel 210 as fasteners are inserted into the channel 210 from one of the open ends 203 or 205, thereby allowing insertion of fasteners into the channel 210 of the elongated body member 208. FIGS. 3 and 4 illustrate end portions 232 and 234 of the resilient tabs 222 and 224 as being engageable with the plurality of fasteners in the channel 210 of the fastener collation tube 200 so as to retain the fasteners therein. More particularly, the end portions 232 and 234 of the resilient tabs 222 and 224 are engageable with an endmost fastener 2 of the plurality of fasteners disposed in the channel 210 of the fastener collation tube 200 to retain the plurality of fasteners therein. The resilient tabs 222 and 224 thus function as a one-way gate allowing fasteners to be inserted into the fastener collation tube 200, and preventing fasteners from falling out of the channel 210 thereof until the flexible tabs 222 and 224 are disengaged from the fasteners by flexing out of the channel 210 as discussed further below. The fastener collation tubes 200 are thus reusable.

In the exemplary embodiment, the resilient tabs 222 and 224 are formed of corresponding partially cut portions of the elongated body member 208, thereby forming a unitary fastener collation tube 200. The fastener collation tube 200 may for example be formed of plastic in a molding or extruding process. And the resilient tabs 222 and 224 may be formed in a stamping or cutting operation on the elongated body member 208, wherein the cut resilient tabs 222 and 224 are subsequently depressed inwardly into the channel 210 of the elongated body member 208 so as to retain the screw fasteners therein as discussed above.

FIGS. 1 and 5 illustrate prongs 186 and 187 extending into the tube holder 180, wherein the prongs 186 and 187 are extendable into the channel 210 of the fastener collation tube 200 and engageable with corresponding resilient tabs 222 and 224 of the fastener collation tube 200 so as to flex the resilient tabs 222 and 224 out of the channel 210 thereof when the fastener collation tube 200 is disposed in the channel 182 of the tube holder 180, whereby the fasteners retained side by side in the fastener collation tube 200 are released therefrom and transferred into the magazine slot 70, and more particularly into the upper portion 71 thereof. In other embodiments, a single prong extending into the tube holder 180 flexes a corresponding single resilient tab in configurations of the fastener collation tube 200 having only one resilient tab protruding into the channel 210 thereof.

FIGS. 1 and 5 also illustrate an alignment prong 190 extendable away from the end wall 79 of the magazine slot 70 and engageable with a top side 221 of the fastener collation tube 200 opposite the end wall 218 thereof. The alignment prong 190 is disposed at an angle relative to the axis of the tube holder 180 so as to engage and bias the fastener collation tube 200 toward the shoulders 77 and 78 of the magazine slot 70 as the fastener collation tube 200 is disposed in the channel 182 of the tube holder 180. The top side 221 of the elongated body member 208 has a concave surface to facilitate cooperative engagement by the alignment prong 190. The alignment prong 190 thus aligns or positions the end wall 218 of fastener collation tube 200 relative to the end wall 79 of the magazine slot 70 when the fastener collation tube 200 is disposed into the channel 182 of the tube holder 180 so as to prevent obstruction of the fasteners by the end wall 79 of the magazine slot 70 as the fasteners are transferred from the fastener collation tube 200 into the upper portion 71 of the magazine slot 70.

FIG. 5 illustrates end portions of the opposing side walls 212 and 214 of the fastener collation tube 200, and more particularly portions of either end 203 or end 205, supportably disposed on the edge portions 183 and 185 of the magazine 60, which are correspondingly aligned with the opposing side walls 212 and 214 thereby providing support for the fastener collation tube 200. The edge portions 183 and 185 thus form an abutment surface against which the fastener collation tube 200 is seatable when disposed in the tube holder 180. The fastener collation tube 200 is generally retained in the tube holder 180 by frictional forces therebetween, which permits operation of the stand-up fastener driving tool 10 when the fastener collation tube 200 is disposed in the tube holder 180, without separation of the fastener collation tube 200 therefrom during operation and handling of the stand-up fastener driving tool 10.

In accordance with a general application or use of the fastener driving tool 10, a plurality of fasteners are securely retained in the fastener collation tube 200, which is readily loadable into the tube holder 180 of the stand-up fastener driving tool 10 so as to transfer the plurality of fasteners into the magazine slot 70 thereof. The fastener collation tube 200 may be removed from the tube holder 180 upon transferring the fasteners therefrom into the upper portion 71 of the magazine slot 70, whereupon the stand-up fastener driving tool 10 is operational without the fastener collation tube 200. As discussed above, however, the stand-up fastener driving tool 10 is operational with the fastener collation tube 200 disposed in the tube holder 180. The fastener collation tube 200 is also readily removable from the tube holder 180 when depleted of fasteners, and is reusable upon reloading a plurality of fasteners therein. Tool operators may thus carry several fastener collation tubes 200 loaded with fasteners, and conveniently load the fastener collation tubes 200 into the tube holder 180 of the stand-up fastener driving tool 10 whether or not fasteners remain in the upper portion 71 of the magazine slot 70 thereby permitting relatively uninterruptable operation of the tool 10.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A portable fastener collation tube for retaining a plurality of fasteners having a head and a shank, and wherein said portable fastener collation tube is removably mountable upon a tube holder of a stand-up fastener driving tool during fastener-driving operations of the fastener-driving tool so as to supply fasteners to a fastener magazine of the stand-up fastener driving tool, comprising:

an elongated body member defining an elongated channel for housing a plurality of fasteners disposable within said channel in a side-by-side relationship, said elongated channel having a longitudinal axis extending between opposite axial ends of said elongated body member, and a substantially T-shaped cross-section comprising a pair of elongated side walls having oppositely disposed interior surfaces for disposition upon opposite sides of the fastener shanks, a pair of elongated side wall shoulders extending outwardly from said oppositely disposed side walls and having interior surfaces for disposition adjacent bottom surface portions of the fastener heads, an elongated end wall disposed substantially opposite said elongated side wall shoulders and having an interior surface for disposition adjacent top surface portions of the fastener heads, and a pair of elongated crown portions interposed between said pair of elongated side wall shoulders and said elongated end wall and having interior surfaces for disposition adjacent side portions of the fastener heads;

a fastener retaining member disposed toward at least one of said axial ends of said elongated body member, wherein said fastener retaining member is engageable with an endmost fastener of the plurality of fasteners when the plurality of fasteners are disposed within said elongated channel of said elongated body member so as to retain the plurality of fasteners within said elongated channel of said elongated body member, and wherein further said fastener retaining member is disengageable from the endmost fastener of the plurality of fasteners so as to release the plurality of fasteners from the fastener collation tube such that the fasteners can be serially discharged into a fastener magazine of the fastener-driving tool; and said elongated body member having elongated external surface means, extending longitudinally between said opposite axial ends of said elongated body member, for engaging interior surface portions of the tube holder of the fastener-driving tool, throughout substantially the entire axial extent of said elongated body member, such that substantially the entire length of said portable fastener collation tube is able to be securely but removably mounted upon the tube holder of the fastener-driving tool during fastener-driving operations of the fastener-driving tool so as to supply fasteners to the fastener magazine of the fastener-driving tool during fastener-driving operations of the fastener-driving tool.

2. The fastener collation tube of claim 1, wherein said fastener retaining member comprises:

at least one resilient tab protruding into said channel of said elongated body member and disposed upon a side of said elongated body member which is disposed toward a first axial end of said elongated body member, whereby the plurality of fasteners retained within said fastener collation tube are releasable from said fastener collation tube when said at least one resilient tab is flexed out of said channel of said elongated body member.

3. The fastener collation tube of claim 2, wherein:

said at least one resilient tab comprising said fastener retaining member comprises two resilient tabs protruding into said channel of said elongated body member, and wherein each one of said two resilient tabs is disposed upon a corresponding side of said elongated body member which is disposed toward said first axial end of said elongated body member.

4. The fastener collation tube of claim 3, wherein:

said two resilient tabs protrude inwardly from said substantially oppositely disposed crown portions of said elongated body member.

5. The fastener collation tube of claim 3, further comprising:

two additional resilient tabs protruding into said channel of said elongated body member and disposed upon corresponding sides of said elongated body member which are disposed toward said second axial end of said elongated body member.

6. The fastener collation tube of claim 2, wherein the resilient tab is formed of a partially cut portion of the elongated body member.

7. The fastener collation tube of claim 1, wherein said fastener collation tube is a unitary member formed of a plastic material.

8. A sortable fastener collation tube, for retaining a plurality of fasteners having a head and a shank, in combination with a stand-up fastener driving tool for driving the fasteners, comprising:

a fastener magazine mounted upon said fastener-driving tool and having a slot for retaining a plurality of fasteners arranged in a side by side manner;

a tube holder mounted upon said fastener-driving tool, connected to said fastener magazine, and having a channel connected to said fastener magazine slot;

said fastener collation tube comprising an elongated body member defining an elongated channel for housing a plurality of fasteners disposable within said channel in a side-by-side relationship, said elongated channel having a longitudinal axis extending between opposite axial ends of said elongated body member, and a substantially T-shaped cross-section comprising a pair of elongated side walls having oppositely disposed interior surfaces for disposition upon opposite sides of the fastener shanks, a pair of elongated side wall shoulders extending outwardly from said oppositely disposed side walls and having interior surfaces for disposition adjacent bottom surface portions of the fastener heads, an elongated end wall disposed substantially opposite said elongated side wall shoulders and having an interior surface for disposition adjacent top surface portions of the fastener heads, and a pair of elongated crown portions interposed between said pair of elongated side wall shoulders and said elongated end wall and having interior surfaces for disposition adjacent side portions of the fastener heads;

a fastener retaining member disposed toward at least one of said axial ends of said elongated body member, wherein said fastener retaining member is engageable with an endmost fastener of the plurality of fasteners when the plurality of fasteners are disposed within said elongated channel of said elongated body member so as to retain the plurality of fasteners within said elongated channel of said elongated body member, and wherein further said fastener retaining member is disengageable from the endmost fastener of the plurality of fasteners so as to release the plurality of fasteners from the fastener collation tube such that the fasteners can be serially discharged into said fastener magazine of said fastener-driving tool;

said elongated body member having elongated external surface means, extending longitudinally between said opposite axial ends of said elongated body member, for engaging interior surface portions of said tube holder of said fastener-driving tool, throughout substantially the entire axial extent of said elongated body member, such that substantially the entire length of said portable fastener collation tube is able to be securely but removably mounted within said channel of said tube holder of said fastener-driving tool during fastener-driving operations of said fastener-driving tool so as to supply fasteners to said fastener magazine of said fastener-driving tool during fastener-driving operations of said fastener-driving tool; and a prong disposed within said tube holder and extending into said channel of said fastener collation tube so as to be engageable with said fastener retaining member of said fastener collation tube and thereby be able to disengage said fastener retaining member from the endmost fastener of the plurality of fasteners when said fastener collation tube is mounted upon said tube holder of said fastener-driving tool.

9. The combination of claim 8, further comprising:

an alignment prong extending away from an end wall of said magazine slot and engageable with said end wall of said elongated body member aligning said end wall of said elongated body member with respect to said end wall of said magazine slot when said elongated body member is disposed within said channel of said tube holder.

10. The combination of claim 8, wherein:

said fastener retaining member comprises at least one resilient tab protruding into said channel of said elongated body member and disposed upon a side of said elongated body member which is disposed toward a first axial end of said elongated body member engageable with an endmost fastener of the plurality of fasteners to retain the plurality of fasteners in the channel of the elongated body member; and said prong extends into said channel of said elongated body member and is engageable with said at least one resilient tab of said elongated body member so as to flex said at least one resilient tab out of said channel of said elongated body member, whereby the plurality of fasteners retained within said fastener collation tube are releasable from said fastener collation tube when said at least one resilient tab is flexed out of said channel of said elongated body member.

11. The combination of claim 10, wherein:

said at least one resilient tab comprising said fastener retaining member comprises two resilient tabs protruding into said channel of said elongated body member, said two resilient tabs being disposed upon substantially opposite sides of said elongated body member which are disposed toward said first axial end of said elongated body member; and two prongs extending into said channel of said elongated body member and engage-able with a corresponding resilient tab of said elongated body member so as to flex said resilient tab out of channel of said elongated body member when said elongated body member is disposed within said channel to said tube holder.

12. The combination as set forth in claim 11, further comprising:

two additional resilient tabs protruding into said channel of said elongated body member and disposed upon corresponding opposite sides of said elongated body member which are disposed toward said second axial end of said elongated body member.

13. The combination as set forth in claim 11, wherein:

said two resilient tabs are partially cut portions of said elongated body member.

14. The combination as set forth in claim 12, wherein:

said two additional resilient tabs are partially cut portions of said elongated body member.

15. The combination as set forth in claim 8, wherein:

said fastener collation tube comprises a unitary member fabricated from a plastic material.

* * * * *